US007296615B2

(12) United States Patent
Devine, II et al.

(10) Patent No.: US 7,296,615 B2
(45) Date of Patent: Nov. 20, 2007

(54) METHOD AND APPARATUS FOR DETERMINING THE LOCATION OF CORE-GENERATED FEATURES IN AN INVESTMENT CASTING

(75) Inventors: Robert H. Devine, II, Schenectady, NY (US); Gary M. Itzel, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/709,451

(22) Filed: May 6, 2004

(65) Prior Publication Data

US 2005/0247425 A1 Nov. 10, 2005

(51) Int. Cl.
*B22C 9/00* (2006.01)

(52) U.S. Cl. ..... 164/516; 164/361; 164/369; 164/45; 164/137

(58) Field of Classification Search ..... 164/516, 164/361, 369, 340, 397, 45, 339, 341, 342, 164/137

See application file for complete search history.

(56) References Cited

U.S. PATENT DOCUMENTS

| | | | | |
|---|---|---|---|---|
| 4,913,217 | A * | 4/1990 | Koch et al. | 164/340 |
| 5,662,160 | A * | 9/1997 | Correia et al. | 164/516 |
| 6,347,660 | B1 * | 2/2002 | Sikkenga et al. | 164/137 |
| 6,505,678 | B2 * | 1/2003 | Mertins | 164/516 |
| 6,582,197 | B2 * | 6/2003 | Coulson | 416/241 R |

* cited by examiner

*Primary Examiner*—Jonathan Johnson
*Assistant Examiner*—I.-H. Lin
(74) *Attorney, Agent, or Firm*—Nixon & Vanderhye P.C.

(57) ABSTRACT

A secondary datum scheme is used for identifying the location of the core-produced internal geometry of hollow investment cast metal parts that are made using a free-floating core design for implementing complex internal structural features. A set of datum pads are cast on a removable portion of the core print out to provide the secondary reference system. This secondary reference system precisely establishes the location of the core-produced internal geometry of the part exclusive of any fixed external primary datum structure/system so that, for example, precision machining and gauging may be performed upon such internal features during subsequent fabrication steps.

9 Claims, 4 Drawing Sheets

METHOD AND APPARATUS FOR DETERMINING THE LOCATION OF CORE-GENERATED FEATURES IN AN INVESTMENT CASTING

BACKGROUND OF INVENTION

Many manufacturers of gas turbine engines are now using advanced investment casting techniques for producing cast metal turbine nozzles or airfoils (e.g., for gas turbine engine blades or vanes) that include intricate air cooling channels to improve efficiency of airfoil cooling. The internal cooling passages are formed in the cast airfoils using one or more complex airfoil shaped ceramic cores positioned in a ceramic shell mold where molten metal is cast in the mold about the core. The ceramic core(s) are responsible for producing internal structural features of the airfoil such as internal cavities and ribs.

A typical ceramic core is made using a plasticized ceramic compound which is injection molded or transfer molded at an elevated temperature in a core die or mold. The core is then hardened by firing or baking. The finished fired core is then positioned within a pattern die cavity in which a fugitive pattern material (e.g., wax or plastic) is introduced about the core to form a core/pattern assembly for use in the well known lost-wax investment casting process. Next, the core/pattern assembly is repeatedly dipped in ceramic slurry, drained of excess slurry, coated with coarse ceramic stucco or sand particles and dried to build up multiple ceramic layers that collectively form a shell mold about the assembly. The pattern then is selectively removed to leave a shell mold with the ceramic core situated therein and molten metal is poured into the mold. After the molten metal solidifies, the mold and core are removed to leave a cast airfoil with one or more internal passages where the core(s) formerly resided.

In the production of hollow metal machine parts, such gas turbine nozzles and airfoils, the above investment casting process is often implemented based upon a free-floating core design. For at least the following among other reasons, as internal geometry designs progress in complexity and incorporate more of the overall 3-D airfoil or nozzle shape, the casting must be able to be "balanced" so as to allow for an optimum fit of the internal geometry to the primary datum scheme of the part thus requiring the core to be a "free-floating" element in the design. However, the use of a free-floating core design causes problems during subsequent production machining of the part. In particular, the use of a free-floating core design results in a certain amount of positional variation of the cast internal features about the fixed external datum structure of the part. Such variation is highly undesirable when attempting to perform accurate gauging or precision machining operations on these core-produced internal features.

Generally, it is only possible to use wall thickness and external layout sections in relation to fixed external datums comprising a primary datum scheme to approximate the position of the internal geometry of a particular cast airfoil/nozzle part. Because of this, automated machining of internal core-produced features is often inaccurate, if not unfeasible. This is due, at least in part, to the fact that conventional automated machining methods rely upon a part's fixed external datum scheme/structure for locating and/or holding a part during machining/gauging operations and this fixed "primary" datum scheme is inaccurate with respect to internal core-produced cast features due to positional variations of the features caused by the use of a free-floating core.

(Conventional commercially available packaged-software applications that are used for controlling most automated gauging and machining equipment typically use this fixed external datum scheme and compute a best fit determination to all datums for an particular part.) In present day complex airfoil designs, a gas turbine airfoil shape must allow for a "best fit" of external airfoil features in such a manner as to achieve and optimize a particular desired turbine throat area. Internal features of the airfoil are generated by utilizing a core during the casting process. The core can float, twist, shift, etc. relative to the external airfoil geometry during the casting process. This movement of the core causes the internal core produced features to be placed in an unknown position relative to the external airfoil shape. Many of these internal core produced features require precise machining to allow for fit up and/or attachment of other components by welding or brazing. Very tight machining tolerances are required to maintain a precise fit or a fit that will allow for successful brazing and or welding of the attached components. If these internal core produced features, which have moved relative to the external features during the casting process, were machined based on fixtureing to the external features, the machining tolerances would be excessive. Consequently, a need exists for a method and/or arrangement for determining the location of the core produced geometry such that the resulting internal core-produced features of the casting may be machined relative to core position not to the external airfoil features.

SUMMARY OF INVENTION

To adequately address the foregoing problems, an independent datum structure/scheme is added to the core. This additional (secondary) datum structure is arranged so as to be convenient for access and checking by conventional modern gauging equipment such as a Coordinate Measuring Machine (CMM). Known conventional casting/manufacturing approaches typically employ only a single fixed exterior-based primary datum structure for locating and/or holding a turbine airfoil or nozzle part during gauging and machining of the core-produced internal features. Since the core design is free floating, an internal structural feature may ultimately be moved/shifted within the profile limits of the casting and casting process. Consequently, a second set of datums integral to the core is used to provide a reference system specific to the core-produced internal cast features. This core-based reference system provides a means to ensure proper orientation and registration of the core geometry and enables accurate gauging and precision machining of the complex internal structural features that may be a part of a particular airfoil or nozzle design.

One aspect of the invention is the establishment of a secondary datum scheme integral to the core which identifies the location of core-produced geometry (e.g., internal structural features of a hollow investment-cast article) exclusive of the external investment shell and/or other wax-produced features. The use of an independent core-based datum system allows for correction or compensation of positional variations between the external casting shell and the core. It also allows design changes such as a shift in the core geometry positional location to obtain a "best fit" of the core to the external airfoil shape while achieving a particular desired throat area. Another aspect is to provide an arrangement of core-produced datum pads on internal portions of a hollow investment-cast turbine part that are easily accessible by conventional gauging equipment and are easily removed by machining. A further aspect is to provide an arrangement for producing a hollow investment cast article (e.g., a turbine airfoil, blade or nozzle) that eliminates or at least minimizes the potential of incurring machining/gauging errors due to positional variations of core-produced features and allows precision machining to be performed on core-produced features relative to any core shift which may occur during casting or which may need to be implemented as a result of design changes/modifications.

BRIEF DESCRIPTION OF DRAWINGS

These and other features and advantages of the present invention will be better appreciated by reading the following detailed description of presently preferred exemplary embodiments in conjunction with the FIGURES in which like reference numerals refer to like elements throughout.

DETAILED DESCRIPTION

In the following description specific details are set forth for purposes of explanation only, and not limitation, with respect to a free-floating ceramic core for use in casting a gas turbine engine part where the core forms a cooling passage in the cast article when the core is removed. The present invention is not limited to the specific example illustrated herein and may be practiced with respect to other investment casting cores to make a variety of castings for other applications from a variety of metals and alloys. It will be apparent to one skilled in the art that the non-limiting example discussed herein below may be practiced in other embodiments that depart from these specific details.

Figure 1:
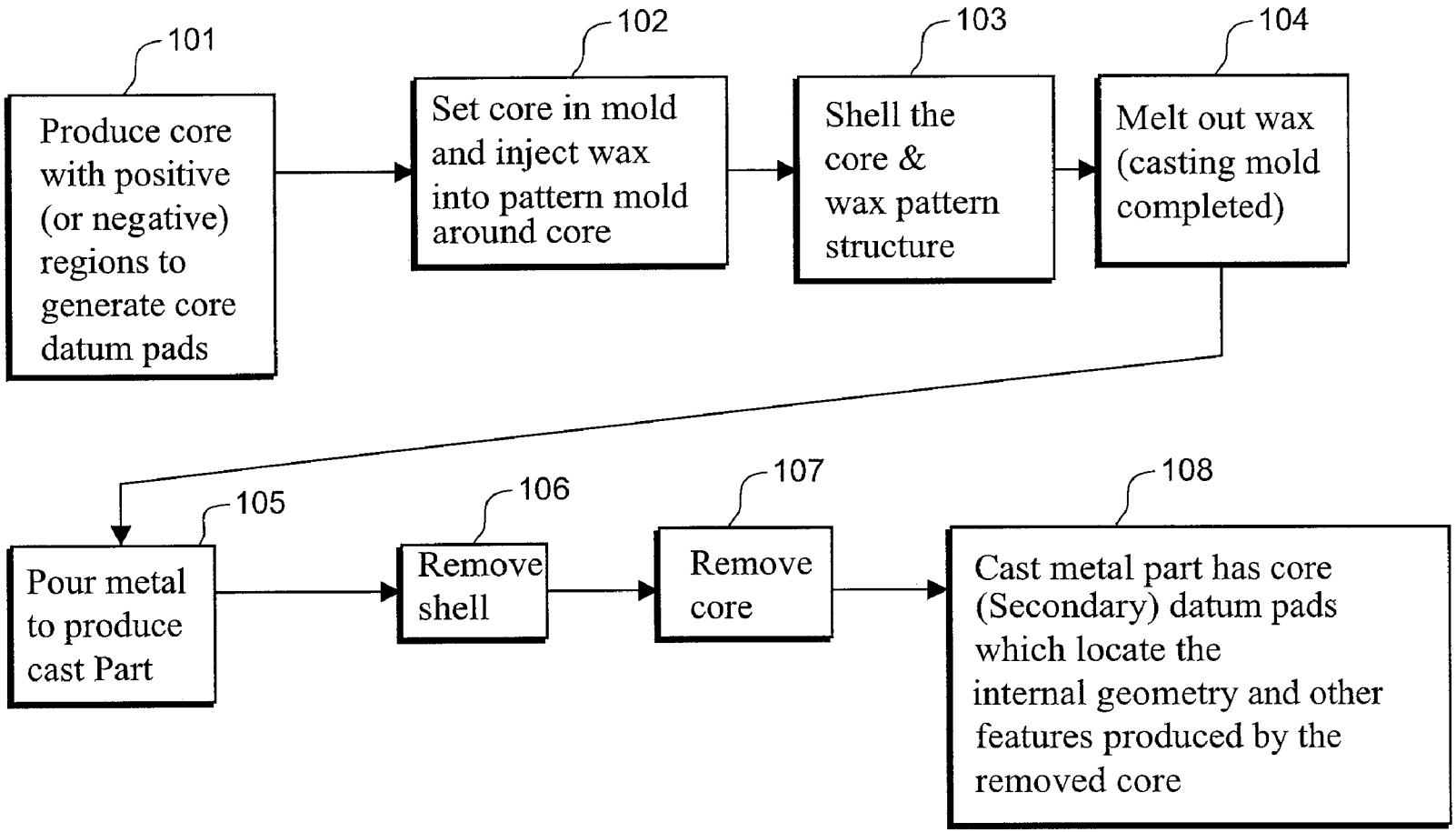
FIG. 1 is a schematic illustration of an example process flow diagram for producing a hollow investment cast metal article having a core-based datum reference system for establishing the position of internal core-produced structural features.

Illustrated in FIG. 1, is an example process flow diagram for investment casting a hollow metal article, such as a turbine airfoil, having a core-based datum reference system for establishing the position of internal core-produced geometry for subsequent gauging or machining operations. Initially, a ceramic core piece is designed which will produce the desired internal structural features of the hollow turbine airfoil. As indicated at block 101, specific datum regions (e.g., small artifacts/structures having positive or negative displacements) are incorporated into the core design to generate datum pads that are integral to the core-produced internal structural features of the casting. Preferably, the core datum pads are incorporated into a core print-out or flash portion of the casting that may be removed by a subsequent machining stage. Next, as indicated in block 102, the core piece having integral datum pad regions is set into the airfoil pattern mold and the fugitive pattern material (e.g., plastic or wax) is injected into the pattern mold around the core. Next, as indicated in procedural blocks 103-107, a conventional lost-wax investment casting process is performed to produce the hollow metal article. After removal of the shell and the core (blocks 106 and 107), the cast metal part is left with an arrangement of core-based datum pads that serve as an accurate reference system for locating the internal geometry and position of structural features produced by the removed core piece, as indicated at block 108.

Figure 2:
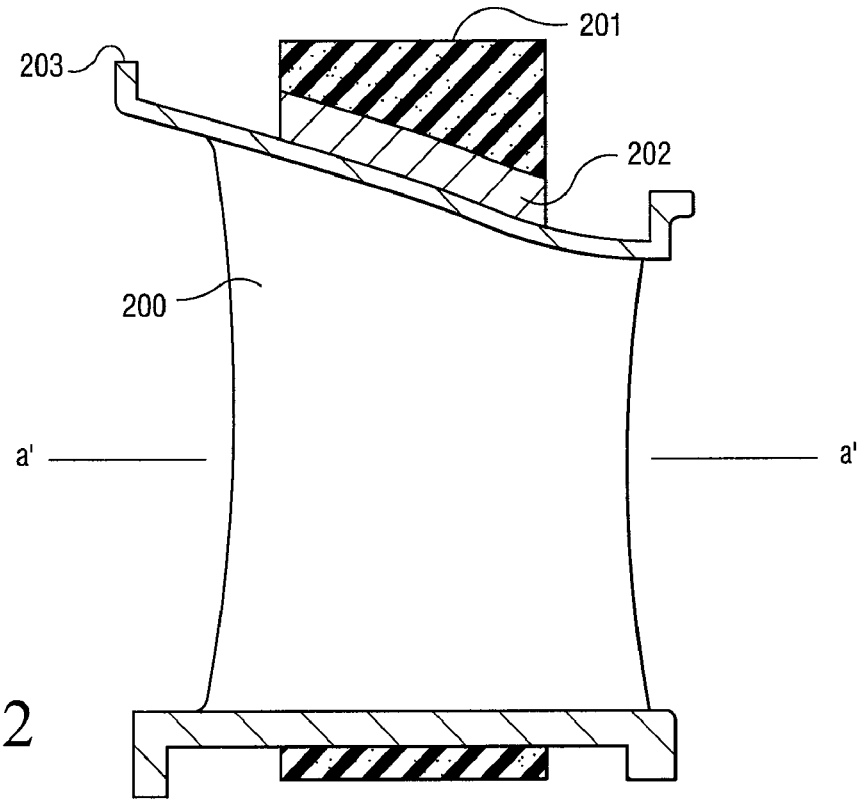
FIG. 2 is a side view of an example investment casting of a hollow airfoil turbine part.
Figure 3:
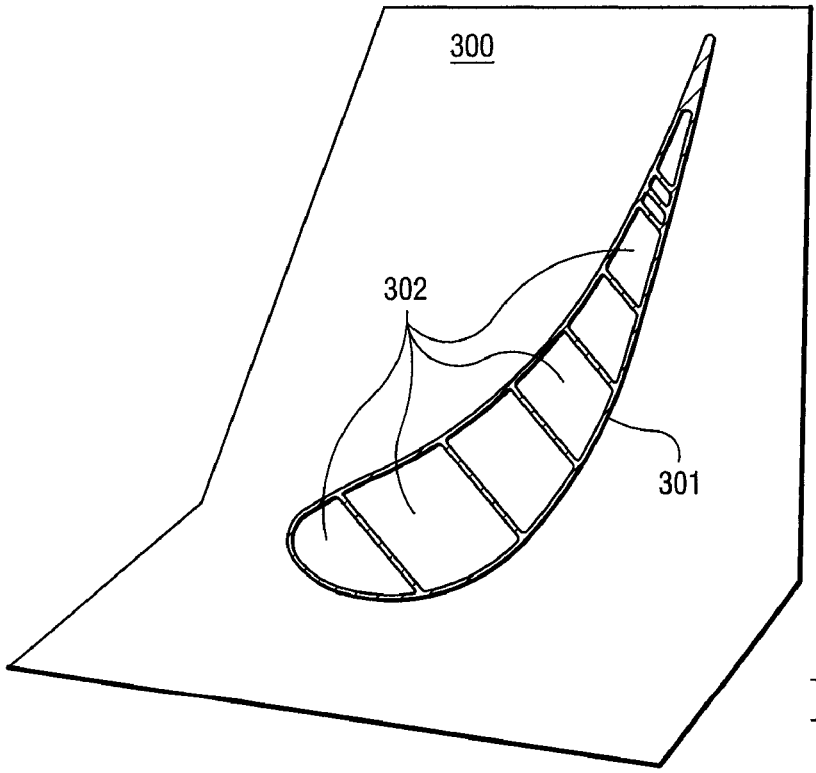
FIG. 3 is a top sectional view of a turbine airfoil casting taken along lines a'-a' of FIG. 2.

FIGS. 2 and 3 show respective side and sectional views of an exemplary investment casting of a gas turbine airfoil part. In FIG. 2, an airfoil body casting 200 is illustrated along with a core piece 201 responsible for generating the cavities and internal structural features of the airfoil part. External raised portion 203 of airfoil body 200 is used to provide a primary datum system 203. Also shown is an exemplary region, 202, of core piece 201 which may be employed for producing a core-based (secondary) datum system. This area is readily accessible and a core print-out or flashing portion located here is easily removed via subsequent machining. In this example, the core print-out (or flashing) produced by core section 202 preferably includes a core-based datum structure of two or more datum pads. FIG. 3 shows a sectional view of FIG. 2 at lines a'-a' which illustrates example core-produced structural features such as ribs 301 and hollow cavity portions 302 that may form the internal air cooling channels of the turbine airfoil part.

Figure 4:
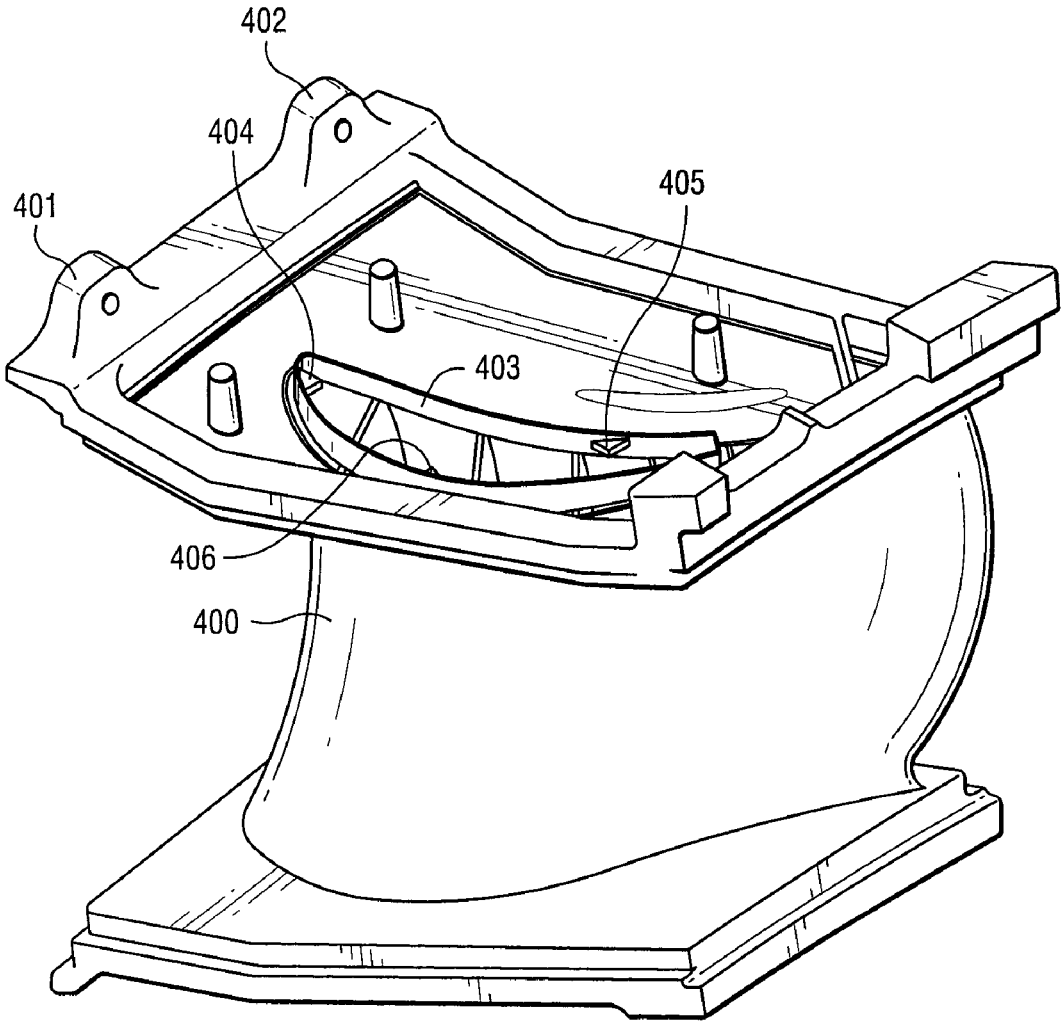
FIG. 4 is a perspective view of a turbine airfoil casting illustrating an example primary datum structure and example core-based datum pads.

Referring now to FIG. 4, a perspective view of an example airfoil casting, 400, is shown which illustrates both an external fixed primary datum structure comprising, for example, pads 401 and 402, and a secondary core-produced datum structure comprising datum pads 404, 405 and 406. In this example, the core-produced datum pads 404, 405 and 406 are integral and internal to core printout portion 403 of airfoil casting 400. Although the detailed structure of an core piece responsible for producing the particular internal features and datum pads illustrated in FIG. 4 is not explicitly shown or illustrated herein, one of ordinary skill will appreciate that the process of producing such a core piece that will generate particular features in a resultant casting is generally known in the art and that a suitable ceramic core piece could readily be fabricated using well known techniques and materials. In the present example, such a core would necessarily be fabricated to include portions that are the inverse or negative of the airfoil internal structures and datum pads shown in FIG. 4.

Figure 5:
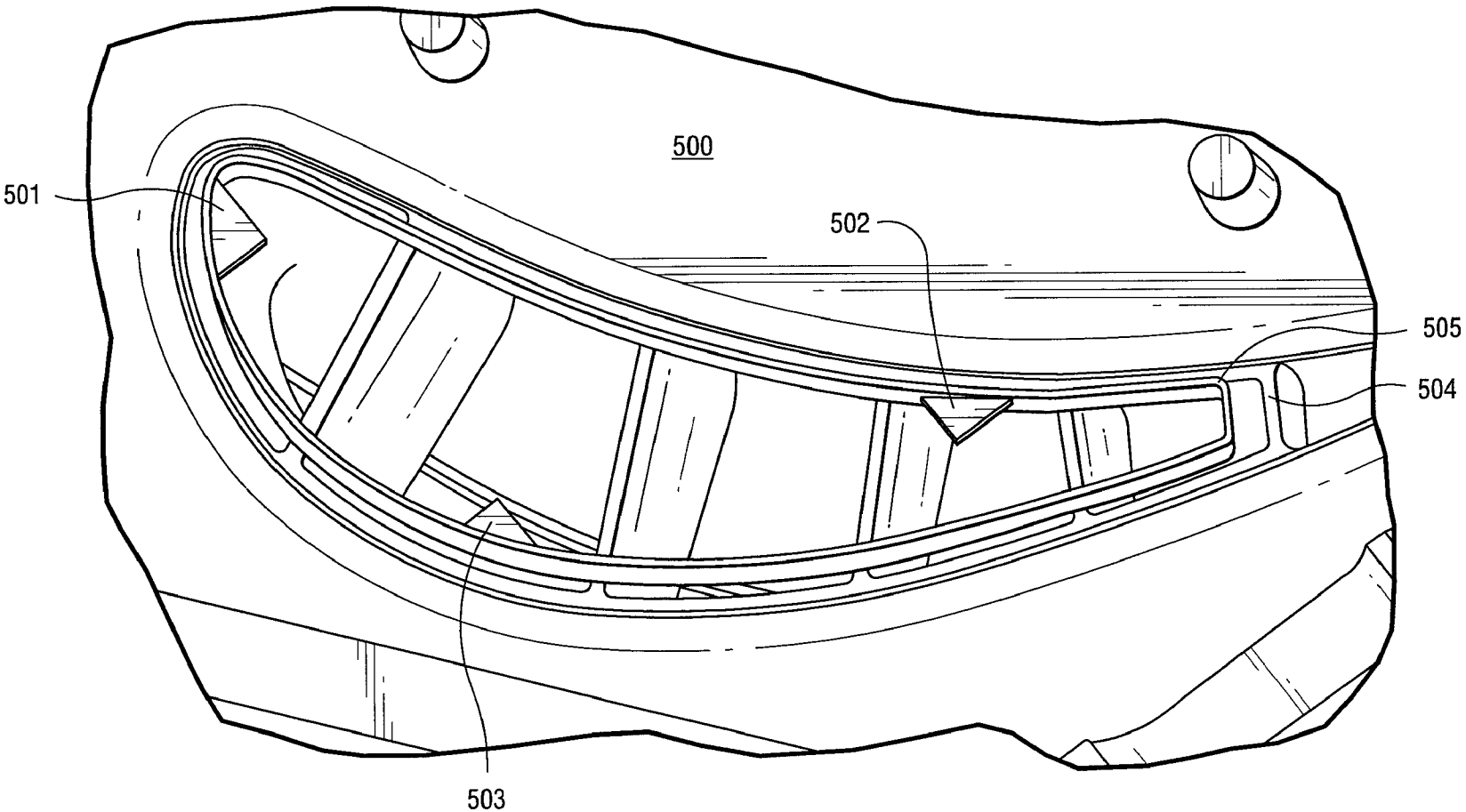
FIG. 5 is a close-up cutaway top view of the turbine airfoil of FIG. 4 illustrating the cast internal structure of an example turbine airfoil having an example set of core-produced datum pads.

In FIG. 5, the example core-based datum system of FIG. 4 is shown in greater detail. In the present example, a plurality of datum pads, 501, 502 and 503, forming the core-based datum structure of airfoil 500 are positioned inside and are integral to the core print-out or flash portion 505 which is connected to and extends from the internal structural features 504 within the airfoil cavity. Although in the non-limiting example arrangement discussed herein the datum pads are shown as a positive region, one of ordinary skill in the art will appreciate that the datum pads may be produced using either positive or negative regions of the core, depending upon such factors as spatial constraints, alloy type and optimum casting characteristics.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A free-floating core for use in investment casting of a turbine airfoil part, the airfoil part having at least one internal cavity and said core including at least one portion that produces a print-out region forming at least a portion of said internal cavity, compromising:

a free-floating core piece having one or more datum pad producing regions integral to the core piece for forming a datum structure on said print-out region of said cast airfoil part, said datum structure being independent of shell mold features, wherein said datum pad or pads serve as a relative position reference system for spatially locating other resultant cast features produced within said internal cavity by said free-floating core, said reference system for use in machining or gauging of core-generated internal cavity features of the airfoil part.

2. The free-floating core of claim 1 wherein said one or more datum pads are located on portions of the core print-out that extend outside of said external cavity and are suitable for removal by machining or other means.

3. A method of fabricating a hollow cast article having a plurality of datum pads which serve as a spatial reference system for enabling precision machine tooling of the cast article, said method based at least in part on an investment casting process using a free-floating core piece, comprising:

forming a free-floating core structure having a plurality of integral positive or negative datum regions for producing datum pads on an investment cast article, wherein said plurality of datum regions are integral to a portion of the core structure that is responsible for producing a core print-out region or flashing region of the cast article that may be removed via subsequent machining;

molding a fugitive material pattern of said article around said core structure;

producing an investment casting of said fugitive material pattern and core structure;

removing the core structure from the casting;

performing machining operations on internal core-produced features of the cast article, wherein the datum pads are used as a spatial reference system for precisely locating said internal core-produced features.

4. The method of claim 3 further comprising removing said core print-out or flashing region containing said datum pads.

5. The method of claim 3 wherein the core is ceramic.

6. The method of claim 3 wherein the datum regions are located at a portion of the core forming an internal cavity portion of the casting.

7. A method for ascertaining the location of core-generated internal structural features in a hollow investment-cast article for gauging and/or machining said features, said article cast using a free-floating core, comprising:

providing a free-floating core having an integral core-based reference datum scheme comprising one or more datum pad producing portions that result in producing one or more datum pads on a core-generated print-out or flashing portion of a cast article, wherein said core-based reference datum scheme is exclusive of any reference datum scheme based upon non-core-generated exterior features of said cast article;

using the datum pads produced on said print-out or flashing portion of said hollow article as a spatial reference system for ascertaining the relative location of internal core-produced features of said investment-cast article.

8. The method of claim 7 wherein said one or more datum pads are formed on a core-generated print-out or flashing portion of said cast article that is removed during a subsequent machining operation.

9. The method of claim 7 wherein said investment-cast article is a gas turbine airfoil or nozzle part having internal air-cooling passages and said one or more datum pads are formed on an internal cavity portion of said part.

* * * * *

UNITED STATES PATENT AND TRADEMARK OFFICE

CERTIFICATE OF CORRECTION

PATENT NO. : 7,296,615 B2
APPLICATION NO. : 10/709451
DATED : November 20, 2007
INVENTOR(S) : Devine et al.

It is certified that error appears in the above-identified patent and that said Letters Patent is hereby corrected as shown below:

Column 5 line 4 after the word "forming" insert the phrase --said datum pad or pads having--

Column 5 line 7 after the "said" insert the phrase --one or more datum pads are located on portions of the core print-out that extend outside of said internal cavity and said--

Column 5 lines 15-16 after the word "pads" delete the phrase "are located on portions of the core print-out that extend outside of said external cavity and"

Signed and Sealed this

Eighth Day of April, 2008

JON W. DUDAS
*Director of the United States Patent and Trademark Office*